US005867582A

United States Patent [19]

Nagayoshi

[11] Patent Number: 5,867,582

[45] Date of Patent: Feb. 2, 1999

[54] HEADPHONE

[75] Inventor: Atsushi Nagayoshi, Katano, Japan

[73] Assignee: Matsushita Electric Industrial Co., Ltd., Kadoma, Japan

[21] Appl. No.: 392,215

[22] Filed: Feb. 22, 1995

[30] Foreign Application Priority Data

Feb. 22, 1994 [JP] Japan ..... 6-23931

[51] Int. Cl.[6] ..... H04R 25/00

[52] U.S. Cl. ..... 381/370; 381/371; 381/380

[58] Field of Search ..... 381/25, 74, 68, 381/68.3, 111, 151, 183, 187, 309, 326, 328, 370, 371, 374, 380; 379/430

[56] References Cited

U.S. PATENT DOCUMENTS

| | | | |
|---|---|---|---|
| 1,983,178 | 12/1934 | Lybarger | 381/183 |
| 3,128,352 | 4/1964 | Cagen | 379/430 |
| 5,109,424 | 4/1992 | Andre et al. | 381/183 |

FOREIGN PATENT DOCUMENTS

| | | |
|---|---|---|
| 63-86997 | 4/1988 | Japan . |
| 63-68288 | 5/1988 | Japan . |
| 63-68289 | 5/1988 | Japan . |

*Primary Examiner*—Huyen Le
*Attorney, Agent, or Firm*—Wenderoth, Lind & Ponack, L. L. P.

[57] ABSTRACT

A headphone has an electroacoustic transducing device for converting an electrical signal to an acoustic signal, a housing for housing the electroacoustic transducing device, a flexible support member of which one end is fixed to the housing, and a vibration member disposed at the other end of the flexible support member. The vibration member generates primary vibrations by an electrical signal having a specific correlation to the electrical signal supplied to the electroacoustic transducing device. The resulting primary vibrations are transmitted through the flexible support member to the housing which then generates secondary vibrations. Unlike the impact vibrations of the primary vibrations, the secondary vibrations felt through the entire housing provide pleasant vibrations similar to air vibrations of the low bass sounds simultaneously to the corresponding low range sounds reaching the eardrum. Thus, low range sounds with dynamics exceeding the output limits of the electroacoustic transducing device is achieved.

11 Claims, 7 Drawing Sheets

HEADPHONE

BACKGROUND OF THE INVENTION

1. Field of the invention

The present invention relates to a headphone functioning primarily as a portable acoustic device and worn on the ear for personal enjoyment of music and other audio sources.

2. Description of the prior art

Headphones can be broadly categorized as head band type headphones supported on the head with the audio output component thereof in proximity to the ear, and inner ear type headphones used while inserted in the auricle. Both types have been improved in recent years by innovations boosting their low frequency reproduction characteristics.

An example of an inner ear type headphone according to the prior art is described below with reference to the accompanying figures.

FIG. 8 is a cross-sectional view of a headphone according to the prior art. As shown in FIG. 8, the headphone comprises an electroacoustic transducing device 161 for converting electrical signals to acoustic signals, and a bone vibrator 120 which has a pressure attaching member 28. The sound signal applied to the electroacoustic transducing device 161 is filtered to a low or a high frequency ranges and applied to the bone vibrator 120, so that the bone vibrator 120 generates vibrations similar to sound signal.

Such a headphone is disclosed in Japanese Patent Laid-Open Publications 63-86997 published Apr. 18, 1988, and Japanese Utility Model Laid-Open Publications 63-68288 and 63-68289 both published May 9, 1988.

The vibrations generated by the bone vibrator 120 are transmitted directly to the bone adjacent the ear through the pressure attaching member 28. Thus, the user will feel more of mechanical impacts rather than the low base sound air pressures. Furthermore, such mechanical impacts applied intensely to a certain point near the ear will give unpleasant pain to the user.

SUMMARY OF THE INVENTION

Therefore, an object of the present invention is to provide a headphone whereby dynamic low frequency sounds exceeding the capacity of the electroacoustic transducing device can be easily experienced through the entire body of the headphone.

To achieve this object, a headphone according to the present invention comprises a housing; an electroacoustic transducing device, provided in the housing, for converting an electrical signal to an acoustic signal; a flexible support means of which one portion is fixed to the housing; and a vibration member fixed at another portion of said flexible support member. The vibration member generates a primary vibrations which are transmitted through the flexible support means to the housing to cause the housing to generate secondary vibrations.

By the invention thus comprised, it is possible to physically experience low bass sounds by transmitting primary vibration through the entire housing which then generates secondary vibrations felt on the skin of the ear. The secondary vibrations are synchronized with the acoustic sound reaching the eardrum.

BRIEF DESCRIPTION OF THE DRAWINGS

The present invention will become more fully understood from the detailed description given below and the accompanying diagrams wherein.

DESCRIPTION OF PREFERRED EMBODIMENTS

The preferred embodiments of a headphone according to the invention are described below with reference to FIGS. 1–5.

Figure 1:
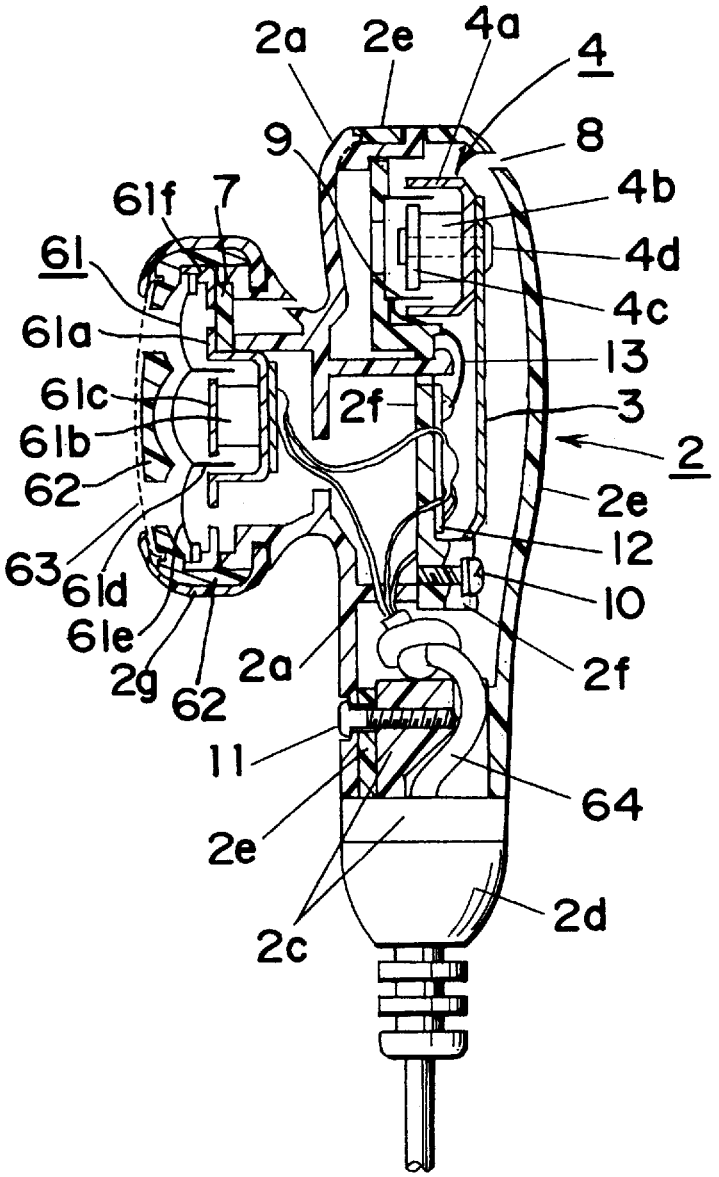
FIG. 1 is a cross-sectional view of a headphone according to the first embodiment of the present invention.
Figure 2A:
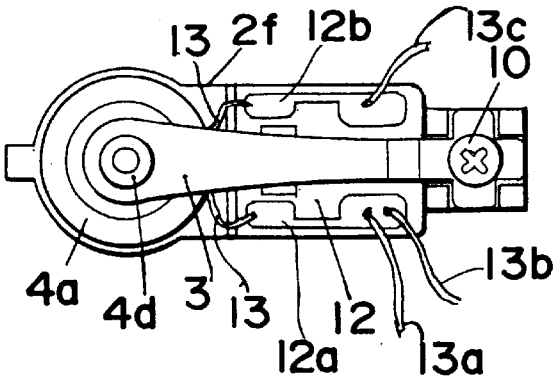
FIGS. 2A, 2B, and 2C are top, front, and side views, respectively, of the vibration generator of the headphone shown in FIG. 1.
Figure 2B:
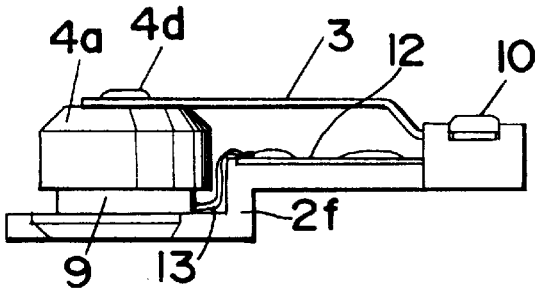
Figure 2C:
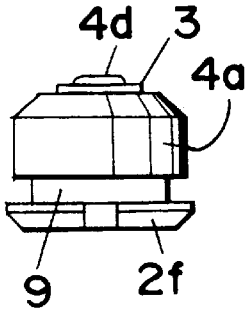

FIG. 1 is a cross-sectional view of a headphone according to the first embodiment of the present invention. FIGS. 2 (*a*), (*b*), and (*c*) are top, front, and side views, respectively, of the vibration generator built into the headphone according to the first embodiment of the invention.

As shown in FIG. 1, this headphone includes an electroacoustic transducing device 61 for converting electrical signals to acoustic signals; a yoke 61*a* made of soft iron, functioning as the magnetic path of the magnetic circuit, and forming the base on which is formed the electroacoustic transducing device 61; a magnet 61*b* of neodymium-iron or samarium-cobalt fixed to the yoke 61*a*; a plate 61*c* made of soft iron, fixed to the magnet 61*b*, and forming with the yoke 61*a* a magnetic gap; a voice coil 61*d* formed as a cylindrical double coil of 50 micron diameter copper-plated aluminum wire; a diaphragm 61*e* bonded to the voice coil 61*d* and formed by thermoplastic molding a 6-micron thick polyester film; a ring 61*f* formed by pressing a 0.5 mm thick brass sheet into a donut-shape, and fastened to the diaphragm 61*e* and yoke 61*a* a housing 2; a unit cap 62; a stainless steel net 63; and a cord 64 comprising three lead wires sheathed in a PVC coating; Note that the electroacoustic transducing device 61 is held securely disposed between the housing 2 and unit cap 62.

The electrical signal fed to the electroacoustic transducing device 61 through the cord 64 flows through the voice coil 61*d*, thus driving the voice coil 61*d* to vibrate the diaphragm 61*e* and produce sound. The sound produced at the front of the headphone passes through the hole provided in the unit cap 62, passes the stainless steel net 63, and is thus conducted into the ear. The sound produced at the back of the headphone is used to control the sound frequency characteristics.

As shown in FIGS. 1 and 2, the headphone further comprises a flexible support member 3 and a vibration member 4.

The housing 2 comprises a first housing 2*a* and a second housing 2*e* behind the first housing. The unit cap 62 is disposed over and fastens the first housing 2*a* and electroacoustic transducing device 61.

Provided at the lower portion in FIG. 1 are: a duct cap 2*c*; a rubber bushing 2*d*; a vibration base 2*f* fastened to the first housing 2*a* and forming the base of the vibration generator; and a rubber ring 2*g* made from an elastomer and fit elastically to the outside of the unit cap 62.

Note that one end of the flexible support member 3 is fastened to the vibration base 2*f*, and the other end is fastened to the vibration member 4.

The vibration member 4 includes: a yoke 4*a* pressed from soft iron, functioning as the magnetic path of the magnetic circuit, and forming the base on which supports the vibration member; a magnet 4*b* of neodymium-iron or samarium-cobalt fixed to the yoke 4*a*; a plate 4*c* made of soft iron, fixed to the magnet 4*b*, and forming with the yoke 4*a* a magnetic gap; and a rivet 4*d* holding the yoke 4*a*, magnet 4*b*, and plate 4*c*, and fastening the vibration member 4 to the flexible support member 3.

The headphone further includes: a damper 7 for applying a constant acoustic resistance to sounds produced at the back of the electroacoustic transducing device 61; a low frequency sound opening 8 disposed in the second housing 2*e*; a coil 9 formed as a cylindrical double coil of 50 micron diameter insulated copper wire, and bonded to the vibration base 2*f*; a screw 10 for fastening the one end of the flexible support member 3 to the vibration base 2*f*; a screw 11 for fastening together the first housing 2*a*, second housing 2*e*, and duct cap 2*c*; a printed circuit board 12 fastened to the vibration base 2*f*; and lead wires 13 from the coil 9.

The printed circuit board 12 includes terminal electrodes 12*a* and 12*b* for the two lead wires 13 from the coil 9, and functions as a terminal block whereby the one terminal electrode 12*a* connects the wires 13*a* and 13*b*, and the other terminal electrode 12*b* connects the wire 13*c*. As best shown in FIGS. 1–2, wire 13*a* is connected to the electroacoustic transducing device 61, and wires 13*b* and 13*c* lead to cord 64.

Figure 3:
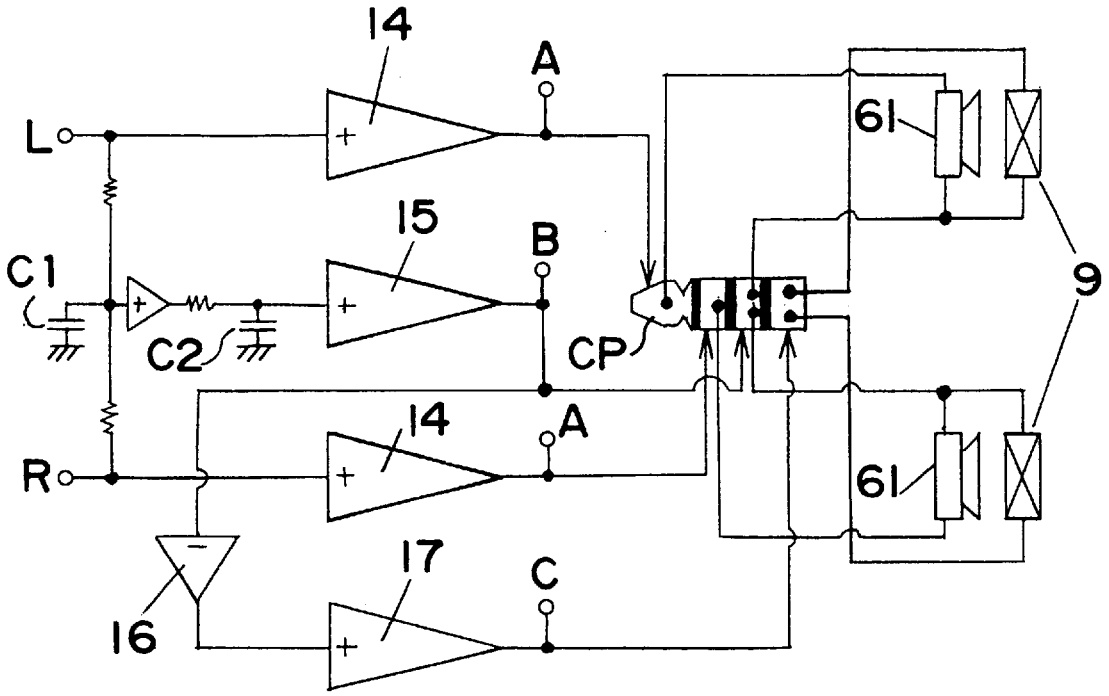
FIG. 3 is a circuit diagram of a circuit for driving the headphone of FIG. 1.

FIG. 3 is a block diagram of the circuitry for driving a headphone according to the first embodiment of the present invention. The electroacoustic transducing device 61 produces acoustic output, and the coils 9 and the vibration members 4 produce vibrations. Also shown are the electrical signal inputs L and R for the left and right stereo input channels; independent power amplifiers 14 for the right and left channels; a center power amplifier 15 to which the electrical signal input to the left and right power amplifiers 14 is input after passing through a secondary low pass filter formed by a capacitor C2; a phase inversion buffer 16 to which the output of the center power amplifier 15 is input; and a vibration driver amplifier 17 to which the output of the phase inversion buffer 16 is input. A primary low pass filter formed by a capacitor C1 is connected to a junction, i.e., a mixing point, between inputs L and R.

It is noted that electroacoustic transducer device 61 and coil 9 are provided in each headphone, and three wires from the headphone lead to a connection pin CP. The phase inversion buffer 16 and the vibration driver amplifier 17 can be provided in the printed circuit board 12 in the headphone, in a control bulge (not shown) provided in the middle of the cable extending between the headphone and the connection pin CP, or in a sound source apparatus, such as a CD player, a cassette tape player, etc., to which the connection pin CP is to be connected. Other parts, such as amplifiers 14 and 15 are provided in the sound source apparatus.

The outputs from the independent left and right channel power amplifiers 14 are connected to the output of the center power amplifier 15 through the discrete left and right electroacoustic transducing devices 61.

The output from the vibration driver amplifier 17 is passed through the left and right coils 9, and connected in common thereby to the output of the center power amplifier 15.

The secondary low pass filter having capacitor C2 is serially connected to an independent primary low pass filter having capacitor C1 as shown in FIG. 3. The cut-off frequency of the primary low pass filter is set to a maximum of several hertz. As a result, the input to the center power amplifier 15 phase inverts relative to the input to the power amplifiers 14 at a frequency of 10 Hz or greater, and has a slope of 12 dB/octave.

Because the vibration driver amplifier output is passed through the phase inversion buffer 16, the output characteristics of the vibration driver amplifier 17 are reverse-phase relative to the output characteristics of the center power amplifier 15, and have a constant gain; the frequency characteristics are similar. In other words, the characteristics at monitor points A, B, and C in FIG. 3 are as shown in FIGS. 4A, 4B and 4C, respectively.

A headphone thus comprised operates as follows.

Figure 4A:
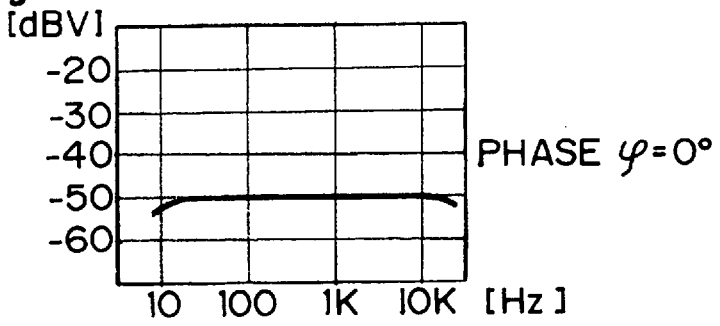
FIGS. 4A, 4B and 4C are graphs of the frequency characteristics of the drive circuit of FIG. 3.
Figure 4B:
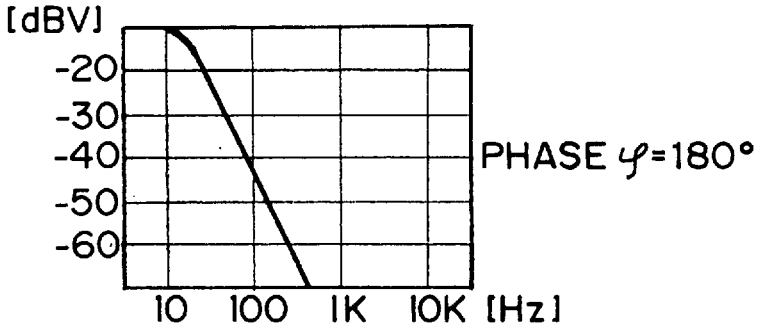
Figure 4C:
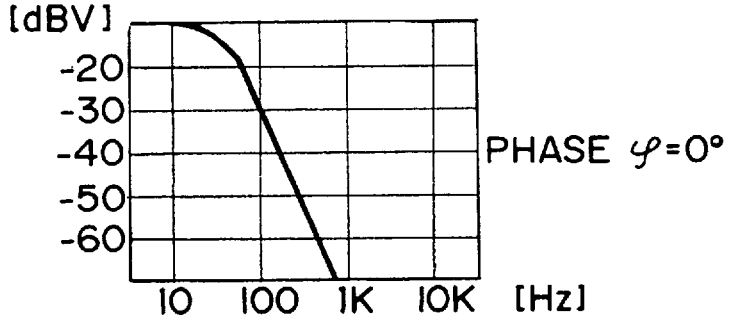

As will be known from the frequency characteristics shown in FIGS. 4A and 4B, the output levels of the power amplifiers 14 and the center power amplifier 15 are equal at approximately 150 Hz, and in reverse phase. The electrical signal applied to both electroacoustic transducing devices 61 at 150 Hz therefore becomes BTL drive, producing a gain of approximately 6 dB if compared to a 1-kHz input signal, and a power increase of approximately four times. At frequencies below 150 Hz, there is an even greater gain in the electrical signals supplied to the electroacoustic transducing devices 61, and the electrical signals supplied to the electroacoustic transducing devices 61 are therefore boosted in the low frequency range. The characteristics of the electrical signals supplied to the coils 9 are the difference between the frequency characteristics shown in FIGS. 4B and 4C. However, because the signals shown in FIGS. 4B and 4C have an approximately 15 dB gain difference but otherwise similar characteristics, the frequency characteristics of the electrical signals supplied to the coils 9 are as shown in FIG. 4C.

When current flows through the coil 9, a force is created between the coil 9 and the yoke 4*a* by the same principle operating in the electroacoustic transducing device 61. This force deforms the flexible support member 3, producing a change in the relative distance between the coil 9 and the yoke 4*a*. Because the electrical signal supplied to the coil 9 is a low frequency band AC signal, the relative distance between the coil 9 and the yoke 4*a* varies, i.e., vibrates, according to this signal, thereby generating primary vibrations at the vibration member 4. In addition, the amplitude of the vibrations has a positive correlation to the level of the electrical signals supplied to the coils 9.

The resonance frequency of the vibrations is described next. If the end of the coil 9 to which the vibration base 2*f* is bonded is considered to be the fixed side, the resonance frequency of the primary vibrations of the vibration member 4 will be determined by the total mass of the vibration member 4 and the elasticity coefficient of the flexible support member 3. In the case of the present embodiment, the most natural effect was obtained through repeated trial comparisons to be 40 Hz. Therefore, a stainless steel plate 100 microns thick was selected for the flexible support member 3, the width of the plate was made irregular as shown in FIG. 2A, and the surface of the plate was coated with a thin silicon rubber film (not shown in the figures) to obtain the desired resonance Q damping factor. The primary vibrations in the low range thus obtained are transmitted through the vibration base 2*f* to the entire housing 2 which thereupon generates secondary vibrations. The secondary vibrations from the entire housing 2 are transferred to the skin of the ear and to the auricle to which the headphone is held. The primary vibrations may produce mechanical impacts, but the secondary vibrations will provide pleasant vibrations similar to air vibrations of the low bass sounds simultaneously to the corresponding low range sounds reaching the eardrum. Thus, low range sounds with dynamics exceeding the output limits of the electroacoustic transducing device can be achieved.

In the above described embodiment, it is possible to eliminate the phase inversion buffer 16 and the vibration driver amplifier 17. In this case, the coils 9 are connected in parallel to electroacoustic transducing devices 61.

By the embodiment thus described, an inner ear type headphone which is to be inserted in the auricle comprises in a housing holding an electroacoustic transducing device for converting electrical signals to acoustic signals, a flexible support member of which one end is fastened to the housing, and a vibration member disposed to the other end of the flexible support member, disposed such that the vibration member is caused to vibrate by an electrical signal obtained from the input electrical signal through a low pass filter, and the resulting vibrations are transmitted through the flexible support member to the housing. Vibrations corresponding to a low range electrical signal can therefore be felt by the skin in the area of the ear, and low bass sounds with presence exceeding the output limits of the electroacoustic transducing device can be experienced.

Figure 5:
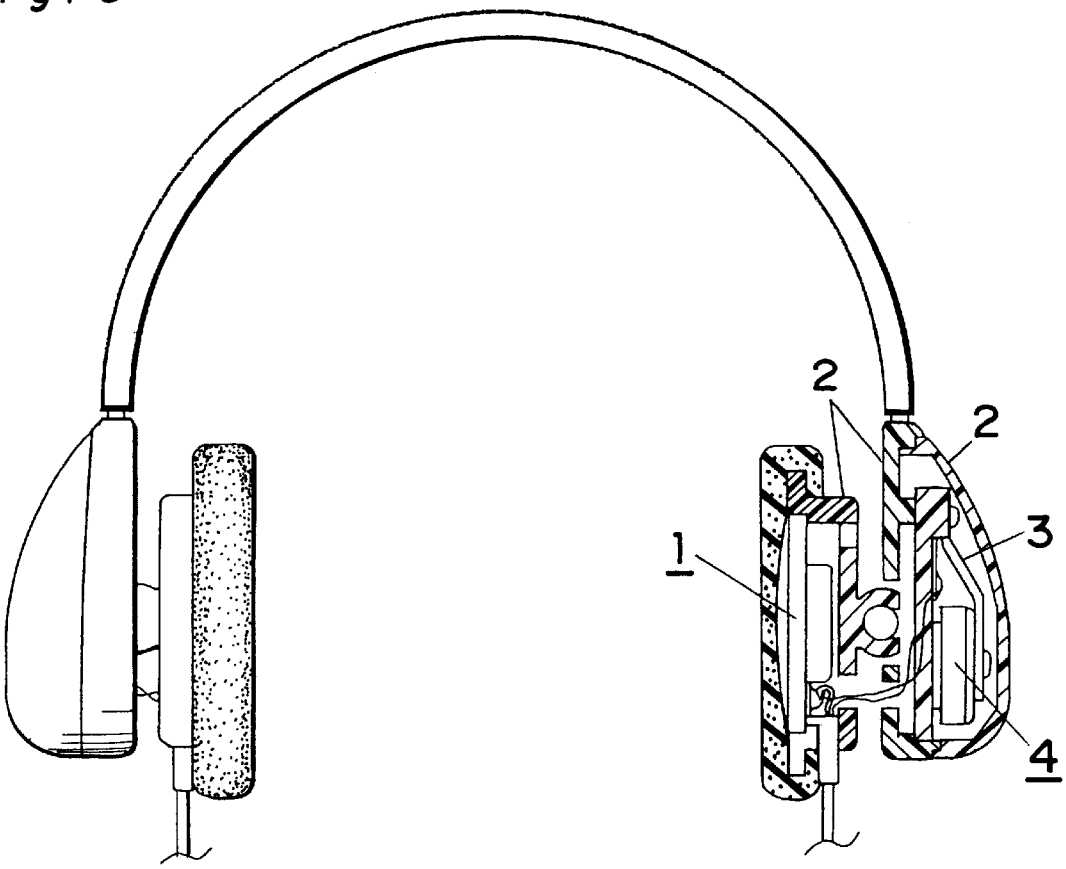
FIG. 5 is a partial cross-sectional view of a headphone according to the second embodiment of the present invention.

Referring to FIG. 5 a head band type headphone according to a second embodiment of the present invention is shown. The headphone of the second embodiment includes the electroacoustic transducing device 1, housing 2, flexible support member 3, and vibration member 4. The drive circuit and operation of this embodiment are identical to those of the first embodiment described above, and further description thereof is omitted below.

It is to be noted that in other possible embodiments of the invention the principles of piezoelectric devices and magnetic speakers can also be applied for converting electrical signals to vibrations.

It is also possible to directly attach the flexible support member to the yoke of the electroacoustic transducing device to form an integrated unit.

Figure 6A:
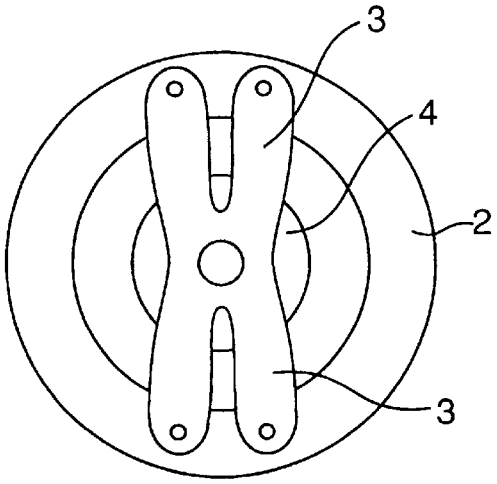
FIGS. 6A and 6B are diagrams showing different patterns of the flexible support member.
Figure 6B:
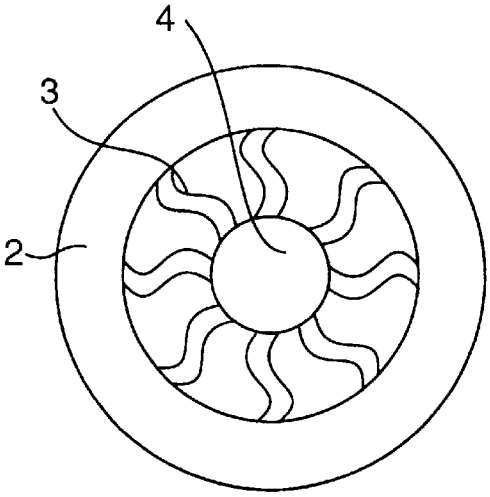

As shown in FIGS. 6A and 6B, the flexible support member 3 can be provided with a plurality of arms. Each arm can be curved in a S-shape, as shown in FIG. 6B. Furthermore, the flexible support member 3 can be arranged in a single plate as in a drum with the center portion thereof fixed to the vibration member 4 and the perimeter portion thereof fixed to the housing.

Figure 7:
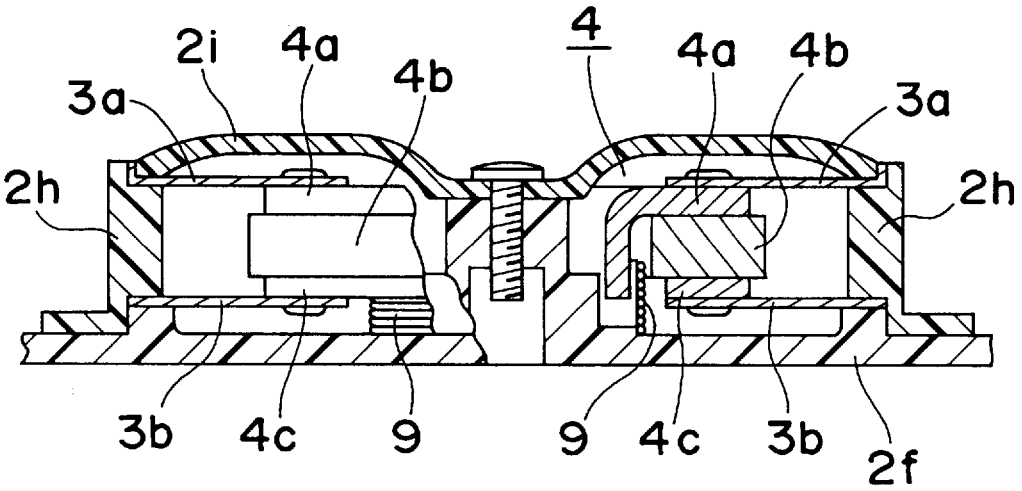
FIG. 7 is a cross-sectional view showing the flexible support members provided on upper and lower sides of the vibration generator.
Figure 8:
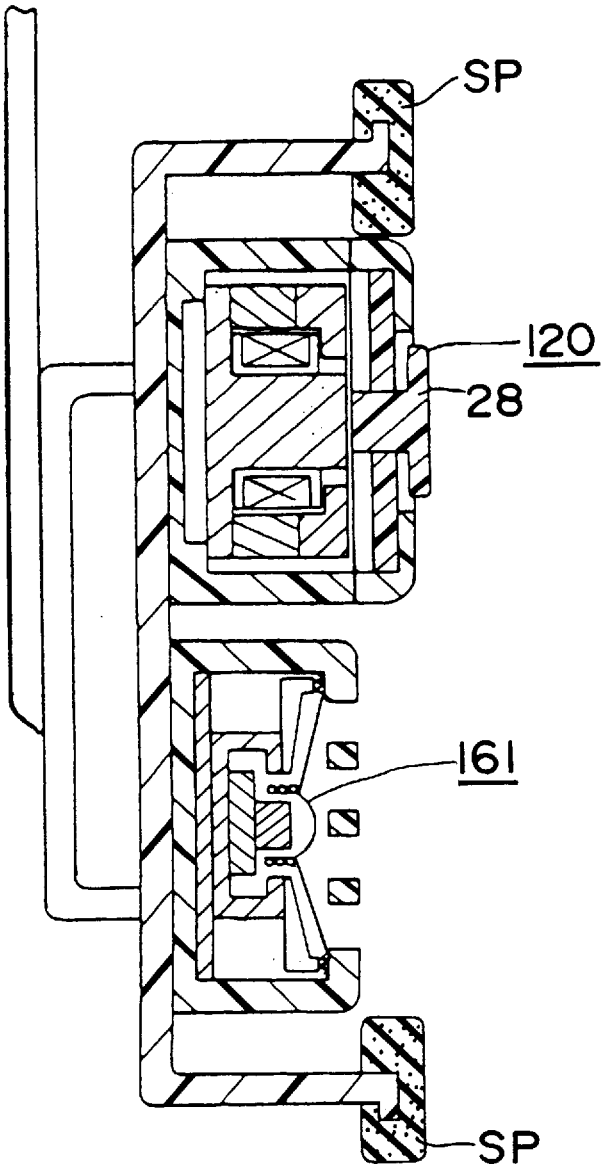
Fig. 8 PRIOR ART
FIG. 8 is a cross-sectional view of a headphone according to the prior art.

As shown in FIG. 7, the flexible support member 3 is divided into upper and lower supporting members 3*a* and 3*b* each having an end firmly connected to yoke 4*a* and plate 4*c*, respectively, and another end firmly connected to the housing 2, such as to vibration base 2*f*. The other ends shown in FIG. 7 are held by a spacer 2*h* inserted between the other ends and a cover 2*i* firmly pressing the other ends over the spacer 2*h*.

In addition, if the mass of the vibration member is greatly increased while simultaneously increasing the elasticity coefficient of the flexible support member and maintaining the same resonance frequency, approximately the same effects can be obtained by eliminating the vibration driver amplifier and using the electrical signal supplied to the electroacoustic transducing device as the signal for generating vibrations.

As described hereinabove, a headphone according to the present invention comprises an electroacoustic transducing device for converting an electrical signal to an acoustic signal, a housing for housing the electroacoustic transducing device, a flexible support member of which one end is fixed to the housing or to a base integrated to the housing, and a vibration member disposed at the other end of the flexible support member. The electroacoustic transducing device characterized by a structure where the vibration member is vibrated by an electrical signal having a specific correlation to the electrical signal supplied to the electroacoustic transducing device. The resulting primary vibrations are transmitted through the flexible support member to the housing which then produces the secondary vibrations. As a result, the secondary vibrations synchronized to a signal having a specific correlation to the acoustic signal produced by the electroacoustic transducing device can be transmitted to the skin of the ear and the auricle at every place where the headphone is touching the skin, and simultaneously to transmission of the acoustic signal as sound to the eardrum. Thus, the user can experience low range sounds transmitted to the skin by the secondary vibrations produced by the housing, originated from the vibration member, with a correlation to the low frequency component signal. As a result, low bass sounds with presence exceeding the output limits of the electroacoustic transducing device can be experienced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A headphone comprising:

a housing defining a cavity;

a vibration member of a predetermined mass located within said housing;

an electroacoustic transducing device, provided in said housing, for converting an electrical signal to an acoustic signal, said transducing device being positionable between an ear of a wearer and said vibration member;

a flexible support member having a first portion and a second portion, wherein said first portion is connected directly to said housing; and said vibration member being connected directly to said second portion of said flexible support member such that said vibration member is held in said housing without contacting the skin of the wearer, even during use, by said second portion of said flexible support member, wherein said vibration member is capable of generating primary vibrations which are transmitted through said flexible support member to said housing, due to said connection between said flexible support member and said housing, to cause said housing to generate secondary vibrations which are strong enough to be sensed by the skin of the wearer in the area of the ear.

2. A headphone as claimed in claim 1, further comprising a base integrated with said housing for supporting said flexible support member.

3. A headphone as claimed in claim 1, wherein said flexible support member comprises an elongated plate.

4. A headphone as claimed in claim 1, wherein said flexible support member comprises a plurality of arms each extending from said vibration member to said housing.

5. The headphone as claimed in claim 4, wherein each of said plurality of arms is S-shaped and extends radially relative to said vibration member.

6. The headphone as claimed in claim 1, wherein said flexible support member has a predetermined coefficient of elasticity in order to transmit a predetermined resonant frequency of vibrations to said housing.

7. The headphone as claimed in claim 6, wherein said flexible support member is located within said housing cavity.

8. The headphone as claimed in claim 1, wherein said vibration member is solely supported by said second portion of said flexible support member such that said vibration member is suspended within said housing.

9. A headphone system comprising:

a headphone including:

a housing defining a cavity;

a vibration member having a predetermined mass and being located within said housing;

an electroacoustic transducing device, provided in said housing, for converting an electrical signal to an acoustic signal, said transducing device being positioned between an ear or a wearer and said vibration member;

a flexible support member having a first portion and a second portion, wherein said first portion is connected directly to said housing; and said vibration member being connected directly to said second portion of said flexible support member such that said vibration member is held in said housing without contacting the skin of the wearer, even during use, by said second portion of said flexible support member, wherein said vibration member is capable of generating primary vibrations which are transmitted through said flexible support member to said housing, due to said connection between said flexible support member and said housing, to cause said housing to generate secondary vibrations which are strong enough to be sensed by the skin of the wearer in the area of the ear; and a filter circuit for filtering a low frequency signal from said electrical signal, and applying said low frequency signal to said vibration member.

10. The headphone as claimed in claim 9, wherein said flexible support member has a predetermined coefficient of elasticity in order to transmit a predetermined resonant frequency of vibrations to said housing.

11. The headphone as claimed in claim 9, wherein said vibration member is solely supported by said second portion of said flexible support member such that said vibration member is suspended within said housing.

* * * * *